United States Patent [19]

Edwards, Jr. et al.

[11] Patent Number: 4,882,459

[45] Date of Patent: Nov. 21, 1989

[54] PRESSURE SENSITIVE SWITCH HAVING RUGGED CONSTRUCTION AND ACCURATE TRIP PRESSURE SETTINGS

[75] Inventors: Stanley H. Edwards, Jr., Asheville; Simon S. Smith, Jr., Fairview; James B. Warren, Arden, all of N.C.

[73] Assignee: Square D Company, Palatine, Ill.

[21] Appl. No.: 282,883

[22] Filed: Dec. 9, 1988

Related U.S. Application Data

[63] Continuation of Ser. No. 132,616, Nov. 2, 1987, abandoned, which is a continuation of Ser. No. 850,312, Apr. 10, 1986, abandoned.

[51] Int. Cl.[4] ..... H01H 35/34

[52] U.S. Cl. ..... 200/83 J; 73/861.47; 200/82 R; 200/83 S

[58] Field of Search ..... 73/861.47; 340/611, 340/626; 92/165, 168 R; 200/83 R, 83 J, 83 P, 83 S, 83 SA, 82 R, 153 T, 56 R, 308

[56] References Cited

U.S. PATENT DOCUMENTS

| | | | |
|---|---|---|---|
| 665,437 | 1/1901 | Hewlett . | |
| 729,503 | 5/1903 | Muller et al. . | |
| 827,060 | 7/1906 | Dawson . | |
| 1,340,646 | 5/1920 | Anderson . | |
| 1,555,419 | 9/1925 | Kimmel et al. . | |
| 2,506,208 | 5/1950 | Gibson | 200/83 |
| 2,758,480 | 8/1956 | Zeller | 74/104 |
| 3,260,816 | 7/1966 | Schad | 200/83 |
| 3,393,612 | 7/1968 | Gorgens | 200/83 J |
| 3,412,223 | 11/1968 | Schad | 200/83 |
| 3,413,428 | 11/1968 | Noth | 200/83 |
| 3,603,983 | 9/1971 | Mitchell | 200/83 J |
| 3,657,501 | 4/1972 | Hoyt | 200/83 J |
| 3,742,166 | 6/1973 | Schaefer | 200/83 SA |
| 3,824,358 | 7/1974 | Edwards et al. | 200/83 S |
| 4,081,636 | 3/1978 | Rice | 200/83 J |
| 4,168,415 | 9/1979 | Edwards, Jr. et al. | 200/308 |
| 4,306,127 | 12/1981 | Payne | 200/83 J |
| 4,433,614 | 2/1984 | Takeuchi | 92/165 PR |
| 4,476,772 | 10/1984 | Gorman | 92/168 |

*Primary Examiner*—Gerald P. Tolin

*Attorney, Agent, or Firm*—James E. Lowe, Jr.; A. Sidney Johnston; Thomas B. Lindgren

[57] ABSTRACT

A pressure sensitive switch has means for producing linear motion in response to pressure, means for springably resisting the linear motion, means for operating a switch after a predetermined linear motion, and a lifter pin having a projection on a first end for slidably engaging a hole in the means for springably resisting the linear motion, the lifter pin being mounted between the means for producing linear motion and the means for springably resisting the linear motion so as to transmit force from the means for producing linear motion to the means for springably resisting the linear motion, the lifter pin decoupling rotational motion between the means for producing linear motion and the means for springably resisting the linear motion. A piston may serve as the means for producing linear motion in response to pressure. The piston is mounted in a cylinder, and is supported on a first end by a fluorocarbon polymer ring and is supported on a second end by a fluorocarbon polymer slip ring which supports an elastomeric O ring, thereby minimizing friction between the piston and the cylinder. The piston has a substantially hemispherical hammer end for engaging the lifter pin without applying a moment to the lifter pin of any significant degree. The lifter pin engages a spring seat which in turn has an operating rod screwed into a threaded hole of the spring seat. The operating rod in turn engages a lever and induces rotational motion of the lever about an axle in order for the lever to operate the plunger of a switch. The switch may be either an electrical switch or an optical switch. The pressure transmitting parts comprising the piston, the lifter pin, the spring seat, and the operating rod are made of high strength materials in order to provide a rugged construction which can withstand pressure transients having a high rate of rise.

18 Claims, 6 Drawing Sheets

PRESSURE SENSITIVE SWITCH HAVING RUGGED CONSTRUCTION AND ACCURATE TRIP PRESSURE SETTINGS

The application is a continuation of application Ser. No. 132,616 filed 11/2/87 which is a continuation of 850,312 filed on Apr. 10, 1986, and now both abandoned.

FIELD OF THE INVENTION

This invention relates to pressure sensitive switches and more particularly to pressure sensitive switches having rugged construction and permitting accurate setting of the trip pressure. Without applying a moment to the lifter pin of any significant degree.

BACKGROUND OF THE INVENTION

Industrial pressure sensitive switches are used in hydraulic control systems, particularly hydraulic control systems for machine tools. Such pressure sensitive switches must meet a number of demanding criteria. The pressure sensitive switches must be capable of operating at their "trip pressure" in an accurate manner. That is, each time the switch operates it should operate at substantially the same "trip pressure". Also, industrial pressure sensitive switches may be subjected to large pressure transients in the hydraulic system. A large pressure transient may occur in the situation where a pressure reservoir is maintained at high pressure and a hydraulic valve is opened to that pressure reservoir very rapidly, as for example, by a solenoid. An example of an industrial pressure switch is shown in Edwards, Jr. et al., U.S. Pat. No. 4,168,415, issued Sept. 18, 1979.

The pressure sensitive switch shown in the Edwards, Jr. et al. reference provides a good general purpose industrial type hydraulic pressure switch. However, when accuracy of the "trip pressure" requirements and requirements for sustaining high rate of rise pressure transients in the hydraulic system exceed the design envelope of the apparatus shown in the Edwards. Jr. et al. reference, the pressure sensitive switch shown in the reference may be unsuitable. Particularly, pressure transients of the order of 1,500 psi/millisecond may occur within modern industrial hydraulic systems, and such transients are outside of the design envelope of the switch shown in the Edwards, Jr. et al. reference. Also, it is desirable to reduce the friction experienced by the piston actuator disclosed in the Edwards, Jr. et al. reference.

SUMMARY OF THE INVENTION

The invention is a pressure sensitive switch having a rugged construction and therefore able to withstand extremely high rate of rise pressure transients in a hydraulic system, and the invention also has greatly reduced friction in a piston pressure actuator so as to have accurately repeatable "trip pressure" characteristics.

The invention has means for producing linear motion in response to pressure, means for springably resisting the linear motion, means for operating a switch after a predetermined linear motion and a lifter pin having a projection on a first end for slidably engaging a hole in the means for springably resisting the linear motion, the lifter pin being mounted between the means for producing linear motion and the means for springably resisting the linear motion so as to transmit force from the means for producing linear motion to the means for springably resisting the linear motion, the lifter pin decoupling rotational motion between the means for producing linear motion and the means for springably resisting the linear motion. A piston may serve as the means for producing linear motion in response to pressure. The piston is mounted in a cylinder, and is supported on a first end by a fluorocarbon polymer ring and is supported on a second end by a fluorocarbon slip ring which supports an elastomeric O ring, thereby minimizing friction between the piston and the cylinder. The piston has a substantially hemispherical hammer end for engaging the lifter pin. The lifter pin engages a spring seat which in turn has an operating rod screwed into a threaded hole of the spring seat. The operating rod in turn engages a lever and induces rotational motion of the lever about an axle in order for the lever to operate the plunger of a switch. The switch may be either an electrical switch or an optical switch. The pressure transmitting parts comprising the piston, the lifter pin, the spring seat, and the operating rod are made of high strength materials in order to provide a rugged construction which can withstand pressure transients having a high rate of rise.

DETAILED DESCRIPTION

Figure 1:
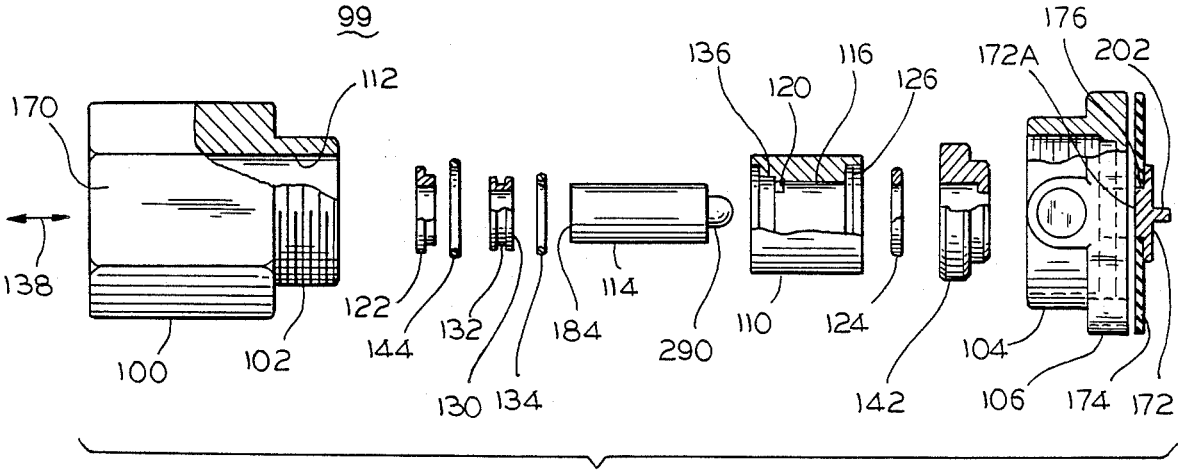
FIG. 1, is an exploded view of a piston assembly.

Piston actuator 99 is shown in FIG. 1. FIG. 1 is an assembly drawing showing piston housing 100 having a threaded portion 102 which screws into a threaded portion 104 of mounting flange 106. Bushing 110 fits into piston housing 100, by fitting into cylindrical opening 112, as shown in more detail in FIG. 3. The outside diameter of bushing 110 and the inside diameter of opening 112 have tolerances such that the fit of bushing 110 into opening 112 is a close fit.

Piston 114 fits into opening 116 of bushing 110. Opening 116 has shoulder 120. The external diameter of piston 114 and the internal diameter of opening 116 at its narrow point, which is at shoulder 120, is such that shoulder 120 clears piston 114. It has been found satisfactory to have the clearance on one side of piston 114 and shoulder 120 to be at least 0.001 inches.

Seal retainer 122 fits closely into opening 116 of bushing 110 at the enlarged end 136 of opening 116. The external diameter of piston 114 and the internal diameter of seal retainer 122 are such that piston 114 does not touch seal retainer 122. A clearance of approximately 0.010 inches on each side of piston 114 has been found to be satisfactory.

Guide 124 slips over piston 114. Also, guide 124 fits against stop 126 cut into opening 116 of bushing 110.

Figure 3:
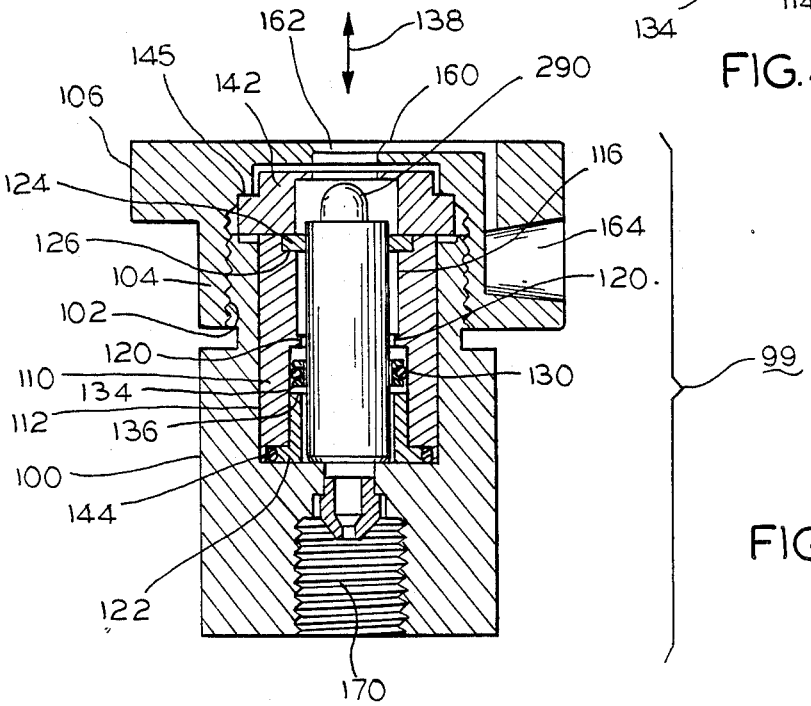
FIG. 3 is a cross-sectional view of a piston assembly.

Slip ring 130 fits onto piston 114. Slip ring 130 has its external surface cut to provide groove 132. O ring 134 fits into groove 132. The outside surface (not numbered) of O ring 134 seals against the inside surface of opening 116 at the larger diameter area designated 136. Seal retainer 122 also fits closely against the larger diameter area 136 of opening 116. Seal retainer 122 serves the function of capturing slip ring 130 as piston 114 moves back and forth in an axial direction as indicated by double headed arrow 138, as shown in FIG. 3 in greater detail.

Guide 124 and the combination of slip ring 130 and O ring 134 support piston 114 within bushing 110. Piston 114 is able to move back and forth in the axial direction as shown by arrow 138 by sliding within guide 124, and also sliding within slip ring 130. No metal to metal contact occurs between piston 114 and bushing 110. The absence of metallic contact against piston 114 provide a low friction movement of piston 114. The low friction movement of piston 114 permits accurate settings of pressure trip points as will be further explained hereinbelow.

Figure 4:
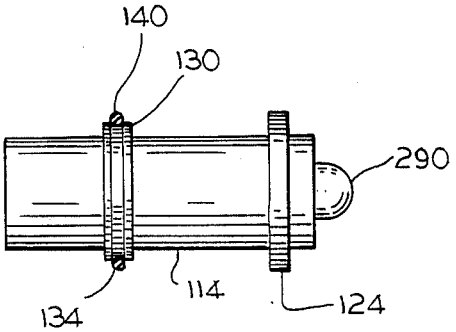
FIG. 4 is a side view of a piston assembly.

FIG. 4 is a detailed view showing piston 114, guide 124 and slip ring 130 with O ring 134 mounted thereupon. Guide 124 contacts opening 116 at shoulder 126 of bushing 110, and the external surface 140 of O ring 134 contacts the internal surface of the larger diameter area 136 of bushing 110. Thus, piston 114 rides on guide 124 and slip ring 130 in its axial motion back and forth in the direction shown by arrow 138.

Spacer 142 seats within mounting flange 106 at shoulder 145 of mounting flange 106. Screwing piston housing 100 into mounting flange 106 at threaded portions 102, 104 compresses O ring 144. O ring 144 is compressed by pressing bushing 110 against spacer 142, which in turn presses against shoulder 145 of mounting flange 106. Compression of O ring 144 provides a static seal for the piston actuator 99.

Figure 5:
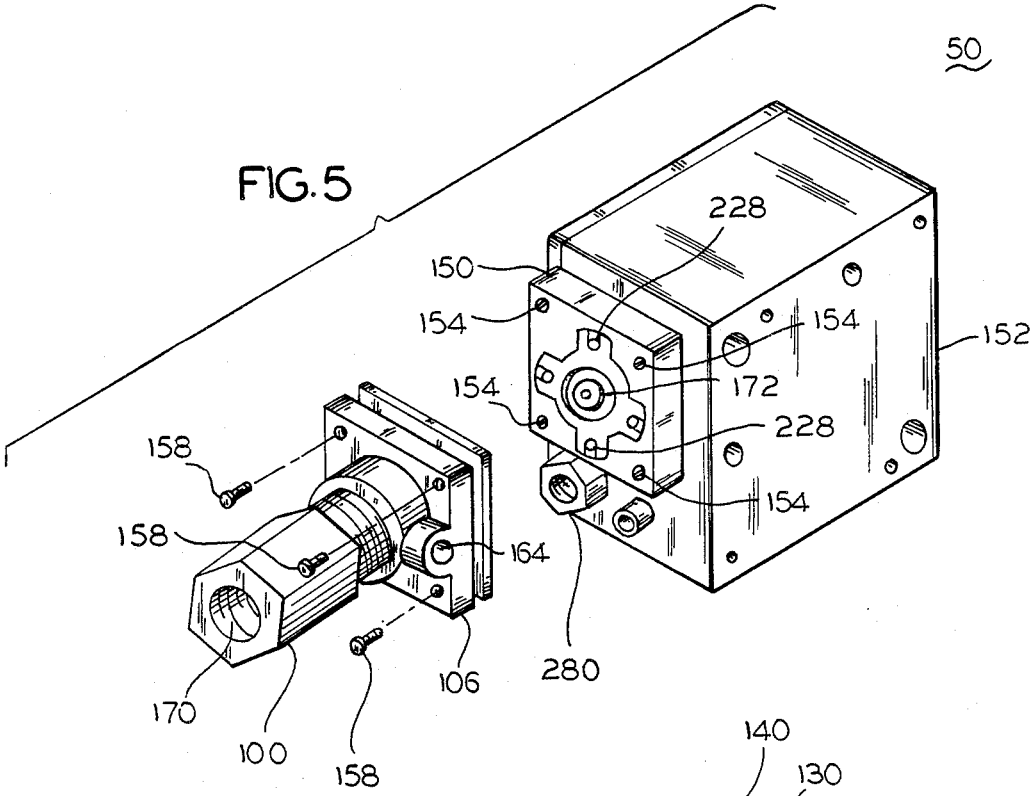
FIG. 5 is an isometric assembly drawing.

FIG. 5 is an isometric assembly drawing showing piston housing 100 screwed into mounting flange 106. Mounting flange 106 in turn attaches to range module housing 150. Range module housing 150 in turn attaches to housing 152. Stack screws 154 attach range module housing 150 to housing 152. Stack screws 154 screw into threaded holes (not shown) made in housing 152. Stack screws 154 also have threaded sockets 156 as shown in more detail in FIG. 8. Sockets 156 have internal threads for accepting screws 158 which attach mounting flange 106 to range module housing 150.

Drain groove 160 (FIG. 3) communicates from opening 162 in mounting flange 106 to drain opening 164. Drain groove 160 and opening 162 are shown in greater detail in the bottom view shown in FIG. 15, and also drain opening 164 is shown. Drain groove 160 provides an outlet channel for any liquid which may be in opening 162 of mounting flange 106. Opening 170 communicates to a hydraulic system in which it is desired to monitor the pressure. The hydraulic system may be a liquid hydraulic system, and the liquid hydraulic fluid will be present in opening 170. Or alternatively, the hydraulic fluid may be a gas such as air. Any hydraulic fluid leaking past the seal retainer 122, the slip ring 130 and O ring 134 combination, and the guide 124 may exit from mounting flange 106 through drain opening 164.

Shoulder 120 provides a surface to restrain motion of slip ring 130. Slip ring 130, in combination with O ring 134, is captured in the space between shoulder 120 and seal retainer 122.

Lifter pin 172 provides connection with the next stage of the apparatus, as will be described in more detail hereinbelow. Lifter pin 172 is captured in opening 176 of gasket 174.

Figure 6:
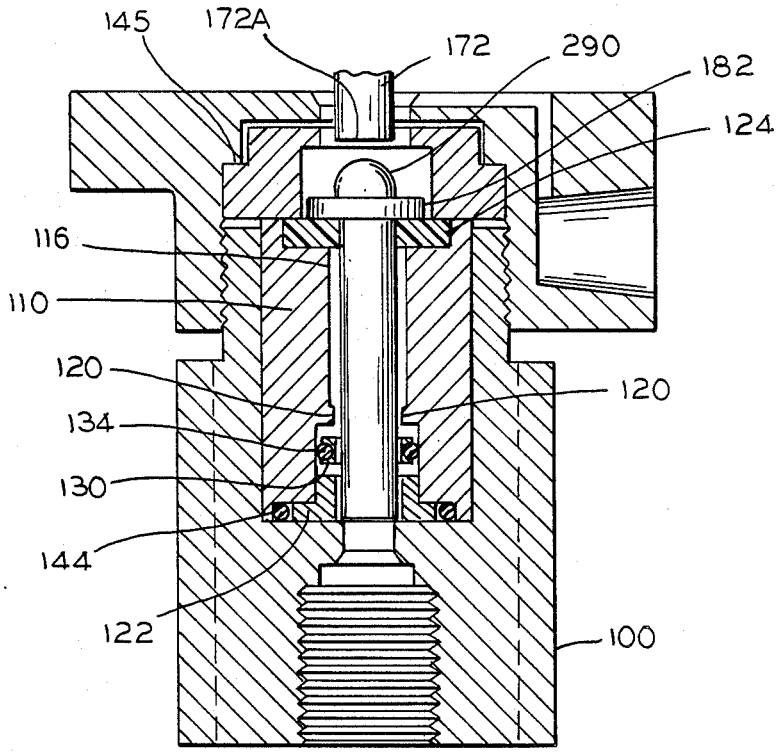
FIG. 6 is a cross-sectional view of a piston assembly.
Figure 7:
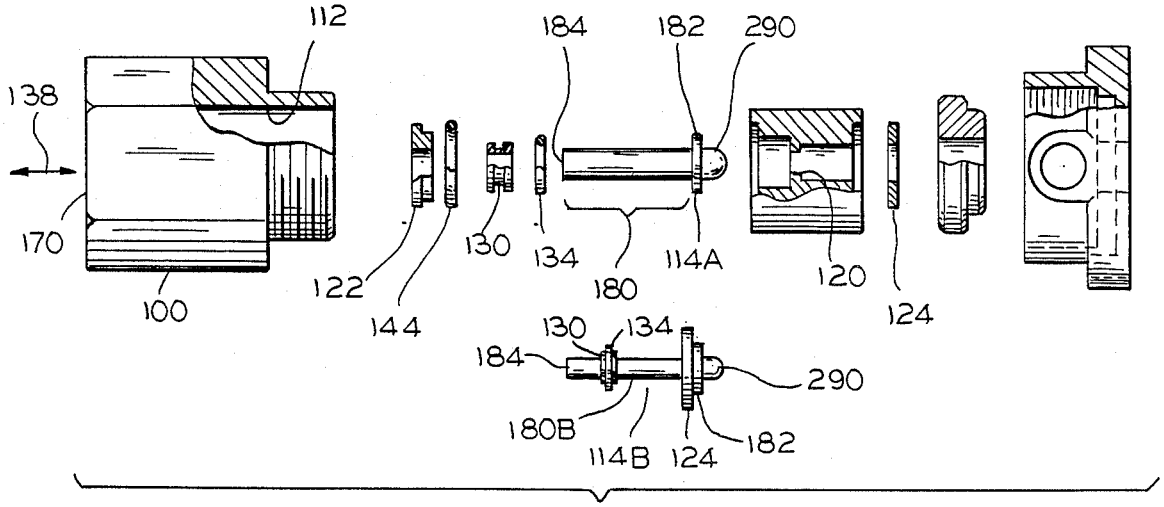
FIG. 7 is an exploded view of a piston assembly.

FIG. 6 and FIG. 7 show an alternative embodiment of a piston actuator. The alternative embodiments of the piston and the associated parts shown in FIG. 6 and FIG. 7 have a smaller diameter shaft 180 for piston 114. Although the dimensions shown in the alternative embodiment of FIG. 7 differ from the dimensions of the embodiment shown in FIG. 1, the same reference numerals will be used to designate like parts in the embodiments. Also, similar reference numerals will be used to designate similar parts. Piston 114A, as shown in FIG. 7, has a collar 182 having an external diameter of substantially the same diameter as piston 114, as shown in FIG. 1. The shaft 180 of piston 114A has a reduced external diameter in order to change the pressure range at which the pressure switch trips, as will be explained in greater detail hereinbelow. Piston 114B has a shaft 180B having an even smaller external diameter than the external diameter of shaft 180. The hydraulic fluid of the system whose pressure is monitored by the invention exerts force against end 184 of the piston. The smaller diameter ends 184 shown on pistons 114A and 114B require correspondingly greater pressures in the hydraulic fluid present in opening 170 in order to exert a given force axially along piston 114, 114A, 114B, respectively. A given axial force on the piston will cause a switch to be operated by the pressure switch, as will be described in greater detail hereinbelow. Thus, the alternative embodiments of the piston provide different ranges of pressure for operating the pressure switch.

The supporting structures for the smaller diameter pistons are sized accordingly, as shown in FIG. 6. Bushing 110 has a smaller diameter opening 116 in order to just clear the smaller diameter pistons 114A and 114B. Shoulder 120 has a smaller diameter for the smaller diameter pistons so that the clearance between the piston and the inside of shoulder 120 is approximately 0.001 inches. Also, seal retainer 122 has an internal opening sized to accommodate the smaller diameter pistons 114A and 114B.

It has been found convenient to make piston 114 as shown in FIG. 1 approximately ⅜ (0.375) inches in diameter. It has been found convenient to make piston 114A as shown in FIG. 7 have a shaft 180 of 0.218 inch diameter, and to leave collar 182 at ⅜ inch diameter. Also, it has been found convenient to make piston 114B have a shaft 180B of 0.156 inch diameter, while maintaining collar 182 at ⅜ inches diameter. A fourth convenient size of piston has a shaft 180B diameter of 0.125 inch while retaining a collar diameter of ⅜ inch. The supporting structures for the different sized pistons are sized to fit the piston as described in the above paragraphs.

Figure 8:
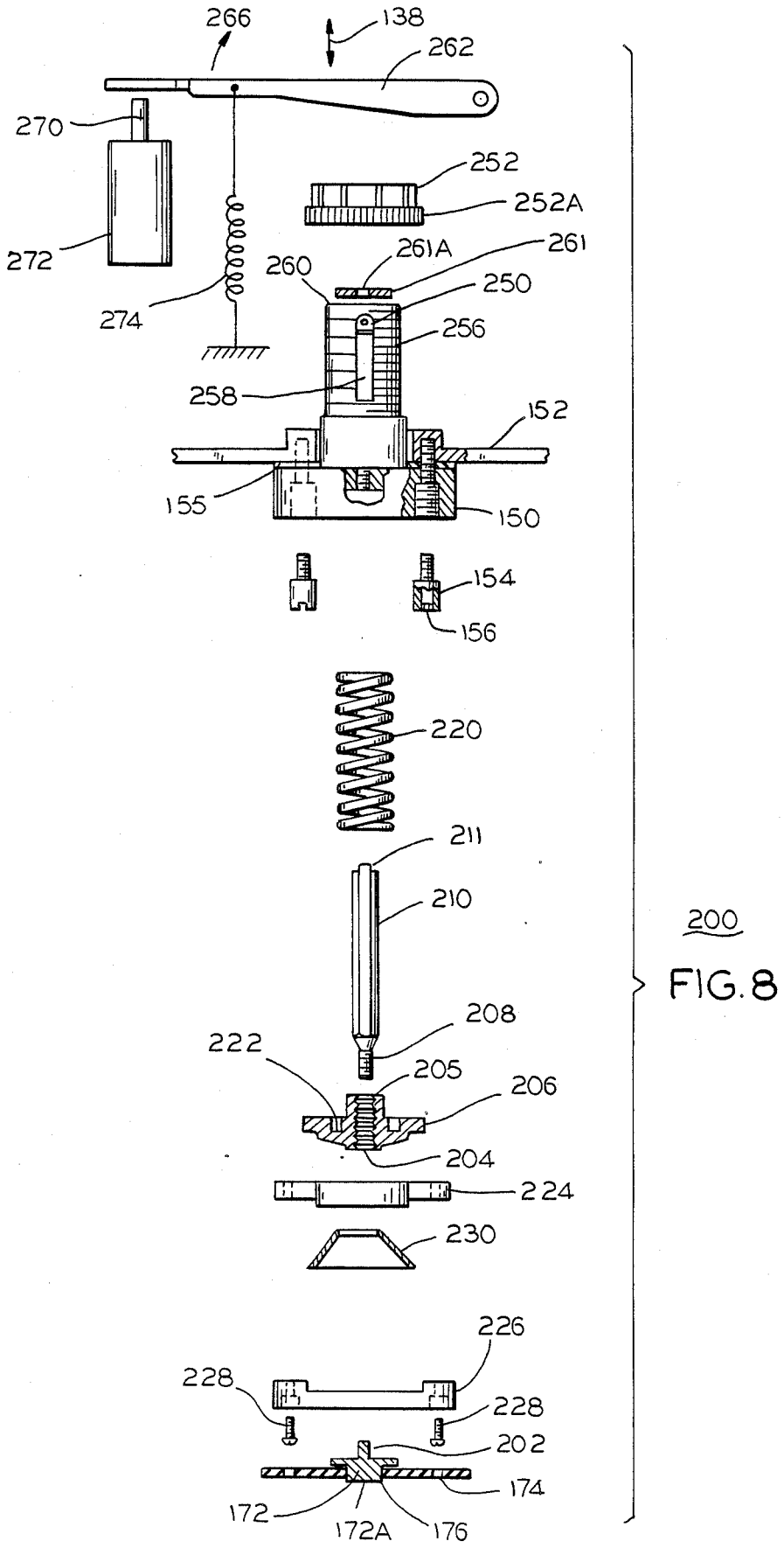
FIG. 8 is a functional exploded view of a range module.

The action of piston 114, 114A, 114B on the range module 200 will now be described. FIG. 8 is a functional exploded view of range module 200. Motion of piston 114, 114A, 114B is transmitted to the range module by lifter pin 172. Pin 202 of lifter pin 172 engages hole 204 formed in lower spring seat 206. Pin 202 of lifter pin 172 has a loose fit in hole 204. Lifter pin 172 decouples horizontal motion or twisting motion of lower spring seat 206 from the piston. Hole 204 is threaded to accept threads 208 formed on the end of rod 210. Range spring 220 seats into groove 222 of lower spring seat 206.

Figure 2:
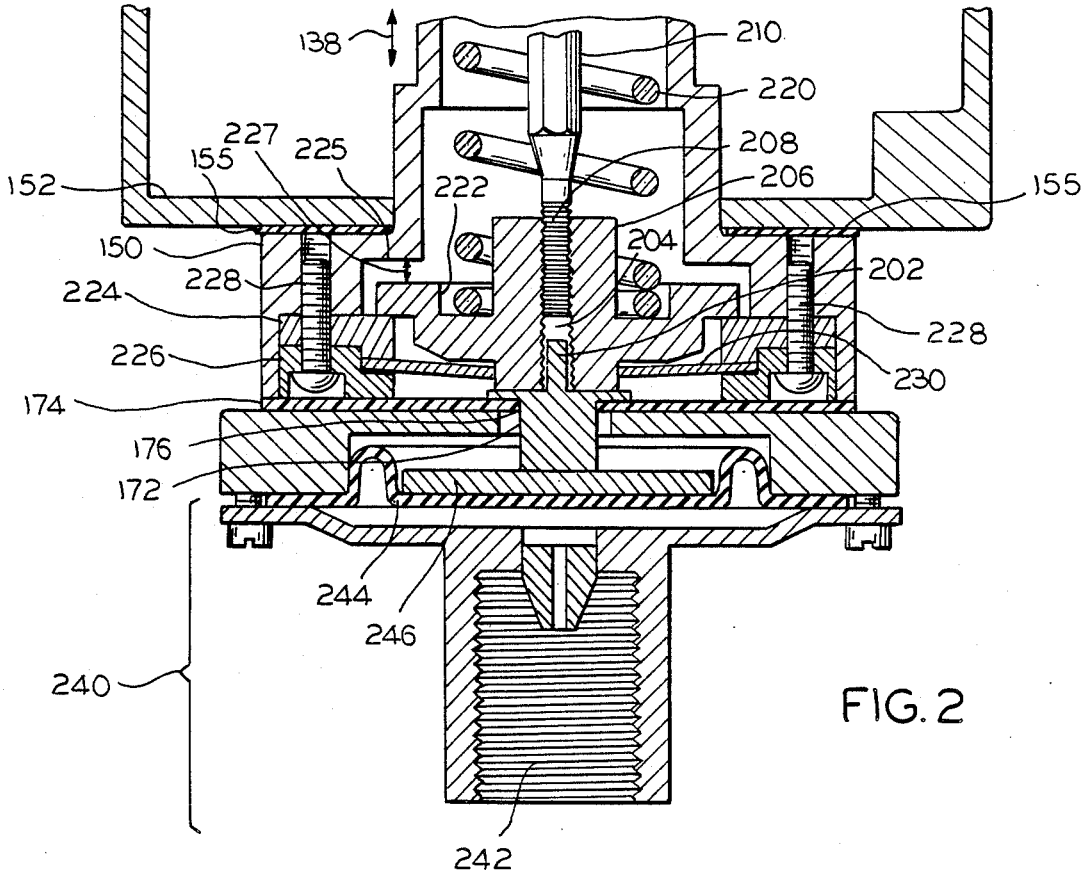
FIG. 2 is a cross-sectional view of an actuator and a range module assembly.

Upper retainer ring 224 forms one end of a cavity in which lower spring seat 206 is retained in range module housing 150, as shown in FIG. 2. The other end of the cavity retaining lower spring seat 206 is formed by shoulder 225. Lower spring seat 206 may move back and forth in the direction shown by arrow 138 within the cavity formed by upper retainer ring 224 and shoulder 225; and has a range of motion shown by clearance 227. A clearance 227 of 0.032 inches has been found to be suitable.

Upper retainer ring 224 and lower retainer ring 226 capture belleville spring 230 therebetween. Lower retainer ring 226 is held against upper retainer ring 224, which in turn is held against range module housing 150, and all are held in place by screws 228. The purpose of belleville spring 230 is to provide a spring bias to offset the bias of other components in order to maintain the calibration of the pressure switch.

FIG. 2 shows the relationship of lower retainer ring 226, upper retainer ring 224, belleville spring 230, and lower spring seat 206. Also, spring 220 is shown seated in groove 222 of lower spring seat 206. Clearance 227 gives the range of motion of spring seat 206 and is shown. Lifter pin 172 is shown passing through opening 176 of gasket 174. Pin 202 of lifter pin 172 is shown seated in hole 204 formed in lower spring seat 206. Rod 210 is shown with threads 208 screwed into matching threads formed on the inside of hole 204.

An alternative pressure actuator 240 is shown in FIG. 2. Alternative pressure actuator 240 has an opening 242 which communicates with a hydraulic system (not shown). Hydraulic fluid in opening 242 exerts a pressure on diaphragm 244. Diaphragm 244 then exerts force against pressure plate 246. Pressure plate 246 then presses against lifter pin 172, causing lifter pin 172 to exert force against lower spring seat 206.

Range spring 220 is captured between lower spring seat 206 and upper spring seat 250 (FIG. 8). Upper spring seat 250 provides a retainer for range spring 220. Range spring 220 is compressed between lower spring seat 206 and the retainer formed by upper spring seat 250 when lower spring seat 206 is moved by the pressure actuator exerting force against lifter pin 172. The amount of force needed for causing motion of lower spring seat 206 is determined by the amount of compression given to range spring 220 by the setting of range nut 252. Range nut 252 moves upper spring seat 250. Upper spring seat 250 is a retainer for the "fixed" end of range spring 220.

Figure 9:
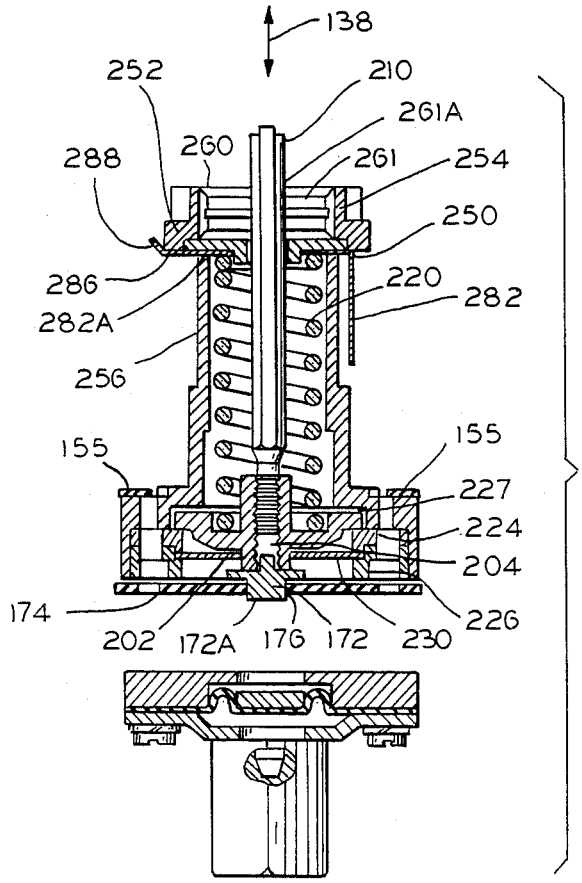
FIG. 9 is a cross-sectional view of a range module and an actuator.

Further detail of upper spring seat 250 is shown in FIG. 9. Range nut 252 has internal threads 254 which thread matingly with external threads 256 formed on the outer surface of the range module housing 150. As range nut 252 screws on threads 254 and 256, it advances along threads 256, thereby moving the upper spring seat 250 in the direction of the lower spring seat 206, thereby compressing range spring 220. As shown more clearly in FIG. 9, upper spring seat 250 extends through slot 258 (FIG. 8) and a corresponding slot (not shown) on the reverse side of range module housing 150. Upper spring seat 250 rides on range nut 252 in order to adjust the compression of range spring 220.

The "trip pressure" is the hydraulic pressure in opening 170 which causes switch 272 to operate. When the hydraulic pressure reaches the "trip pressure" then lifter pin 172 applies just sufficient force to lower spring seat 206 to cause lower spring seat 206 to leave contact with upper retainer ring 224 and move into contact with shoulder 225. Thus, upper spring seat 206 moves through a distance given by clearance 227. During the mid part of motion of upper spring seat 206 through clearance 227, operation of switch 272 is caused by lever 262 being rotated by rod 210.

The "trip pressure" may be adjusted by selecting the position of range nut 252 and the corresponding compression of range spring 220. The compression of range spring 220 determines the force which must be exerted by lifter pin 172 in order to move upper spring seat 206 out of contact with upper retainer ring 224.

Guide 261 (FIGS. 8. 9) fits into end 260 of range module housing 150 and also guide 261 has a hole 261A centered therein (FIGS. 8, 9). Rod 210 fits slidably through hole 261A. Guide 261 serves to stabilize the motion of rod 210. Guide 261 may conveniently be made of plastic and may be force fitted into end 260 of range module housing 160.

Figure 10:
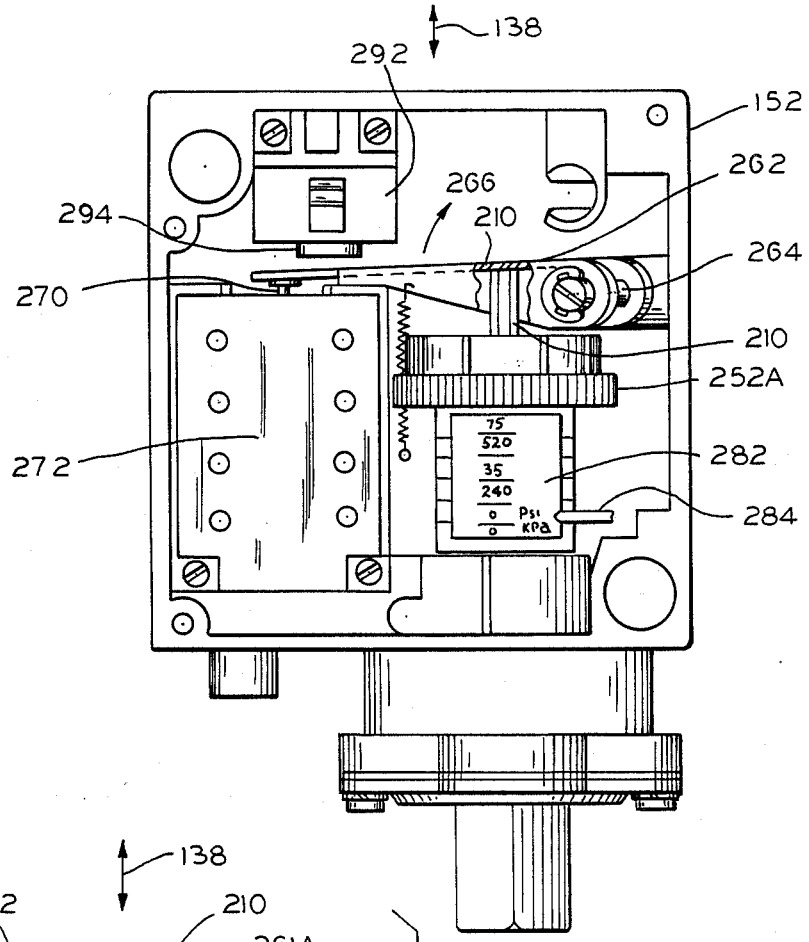
FIG. 10 is a front view of a pressure switch.

Rod 210 protrudes beyond end 260 of range module housing 150 and presses against lever 262 (FIG. 10). Lever 262 is pivoted on axle 264. In FIG. 10, rod 210 is shown seated against lever 262. When pressure in a hydraulic system (not shown) causes motion of lifter pin 172, where that motion tends to move lower spring seat 206 toward upper spring seat 250 thereby compressing range spring 220, then rod 210 causes rotary motion of lever 262 about axle 264 in the direction shown by arrow 266. Motion of lever 262 about axle 264 in the direction shown by arrow 266 allows plunger 270 of switch 272 to move out of switch 272, thereby changing the state of switch 272 to its high pressure indicating state. When hydraulic pressure on the actuator is released, then spring 220 forces lower spring seat 206 to return to contact with upper retainer ring 224 and also returns lifter pin 172 to its low pressure position. Lever return spring 274 urges lever 262 to rotate about axle 264 and maintain contact with rod 210, thereby moving plunger 270 into switch 272, and returning switch 272 to its low pressure indicating state.

The output of the pressure sensitive switch 50 (FIG. 5) is the change in state of switch 272. Switch 272 communicates through conduit hub 280 to external circuitry (not shown). Switch 272 may be an electrical switch, and may particularly be a double-throw snap switch having either one pole or a plurality of poles. One throw position is engaged when the pressure is below the "trip pressure" and the other throw position is engaged when the pressure exceeds the "trip pressure".

Alternatively, switch 272 may be an optical switch. A suitable optical switch is shown in Newell, et al., U.S. Pat. Application Ser. No. 791,802, filed on Oct. 28, 1985. The optical switch may provide an optical path between fiber optical cables when the pressure is below the "trip pressure", and interrupt the optical path when the pressure exceeds the "trip pressure". Alternatively, the optical switch may provide the optical path when the pressure is above the "trip pressure" and interrupt the optical path when the pressure is below the "trip pressure". The optical switch described in the Newell, et al. supra. is a "double throw" optical switch which controls two optical paths in separate fiber optical cables so that it "makes" one optical path and "breaks" the other as the plunger goes either "in" or "out" of the switch body.

Calibration of the range module is illustrated in FIG. 9 and FIG. 10. Range display plate 282 is shown in a side view of FIG. 9 and in a front view of FIG. 10. Range display plate 282 has an extension 282A which fits between upper spring seat 250 and range spring 220. Thus, as range nut 252 advances on threads 254, 256 it moves range display plate therewith. Pointer 284 is attached to housing 152. Pointer 284 then points to numbers printed on range display plate 282. The numbers printed on range display plate 282 indicate the "trip pressure" at which the apparatus is set. Greater compression of range spring 220 gives a higher "trip pressure", as shown by the numbers in FIG. 10. Numbers above the line on range display plate 282 indicate pounds per square inch, abbreviated as psi. Numbers below the line indicate the equivalent metric units such as kilo-Pascal, abbreviated kPa.

Extension 282A of range display plate 282 has an extension 286 which acts as a lock spring for locking range nut 252 into position. Serrations 252A in ring 288 of range nut 252 capture lock spring 286, thereby permitting lock spring 286 to prohibit rotation of range nut 252. Range nut 252 may be turned by a person by that person overcoming the resistance offered by lock spring 286 and thereby releasing range nut 252.

Lifter pin 172 provides a great advantage for piston operated pressure actuators as shown in FIG. 1, 3, 4, 5, 6, and 7. During calibration, range nut 252 is rotated on threads 254, 256 in order to effect compression of range spring 220. Rotation of range nut 252 can cause rotation of lower spring seat 206. If rotation of lower spring seat 206 is transmitted to piston 114 in a piston type pressure actuator then the piston may twist in its seating. Twisting of the piston 114 in its seating may cause the piston to bind. Binding of the piston will affect the "trip pressure" operating point of the apparatus. Insertion of lifter pin 172 between lower spring seat 206 and piston 114 decouples rotational or transverse motion of the spring seat from the piston. This decoupling of the motion of the spring seat from the piston reduces or eliminates binding of the piston as a result of rotational motion of the spring seat when range nut 252 is rotated.

Pin 202 of lifter pin 172 fits loosely in hole 204 of lower spring seat 206. This loose fit further enhances the decoupling of rotational or sidewise motion of lower spring seat 206 from piston 114, 114A, 114B.

An additional feature of the design of piston 114 to further affect decoupling of rotational motion of lower spring seat 206 from the piston is the rounded hammer 290 of pistons 114, 114A, and 114B. The rounded hammer 290 structure of pistons 114, 114A, 114B strikes flat surface 172A of lifter pin 172.

The rounded hammer 290 structure may be conveniently chosen to be a substantially hemispherical shape. A hemispherical shape of radius 0.1 inch has been found to be suitable. A convenient diameter of surface 172A of lifter pin 172 has been found to be 0.250 inch. This diameter of surface 172A has been found suitable for mating with a 0.1 inch hemispherical radius of hammer 290.

The mounting of piston 114, 114A, 114B by a guide 124 and a slip ring 130 fitted with an O ring 134 provides a great advantage in that friction between the piston and bushing 110 is minimized. In order to have an accurately set "trip pressure" it is necessary to have a low friction motion of the piston within bushing 110. It has been found convenient to use a fluorocarbon polymer such as Teflon (Teflon is a trademark of E. I. du Pont de Nemours and Company) for guide 124. It has also been found convenient to use a fluorocarbon polymer for slip ring 130 and to use an elastomeric material such as rubber or synthetic rubber for O ring 134. The use of these materials prevents any metal to metal contact between piston and bushing 110. The piston 114, 114A, 114B and bushing 110 are typically made of stainless steel. A metal to metal contact between the piston and the bushing greatly increases friction and makes difficult the maintenance of an accurate "trip pressure". The use of a piston suspended by fluorocarbon polymer and elastomeric materials greatly improves the accuracy of the "trip pressure" setting.

The design of the apparatus is adaptable to a very rugged construction using many steel parts. For example, piston housing 100, piston 114, 114A, 114B, bushing 110 and spacer 142 may conveniently be made out of stainless steel Lifter pin 172 and rod 210 may conveniently be made of heat treated carbon steel. Lower spring seat 206 may conveniently be made of high strength aluminum. The use of these high strength materials for piston 114, 114A, 114B, and lifter pin 172, and lower spring seat 206, and rod 210 provides a continuous rugged connection between the point where pressure is applied against surface 184 of the piston and lever 262. This high strength construction allows the apparatus to withstand pressure transients as great as 1,500 psi/millisecond. Such a high rate of rise of a pressure transient may occur in hydraulic systems in which a pressure reservoir is maintained at high pressure, and a hydraulic valve is suddenly opened by a solenoid. Such a pressure transient may destroy a pressure switch of less rugged construction. An additional structure (FIG. 10) to mitigate the effects of pressure transients having a high rate of rise is provided by stop 292 and cushion 294. Lever 262 may be driven away from contact with the end of rod 210 by a pressure transient, and when this occurs lever 262 will impact cushion 294. Cushion 294 is made of a resilient material which absorbs kinetic energy of motion of lever 262 when such an impact occurs.

Range module housing 150 is attached to housing 152 by stack screws 154. Gasket 155 fits between range module housing 150 and housing 152 as shown in FIG. 2 and FIG. 9.

The apparatus may be adjusted so that rod 210 properly contacts lever 262, as shown in FIG. 10, by rotating rod 210 so that threads 208 formed on the end of rod 210 intermesh with threads 205 formed on the inside of hole 204. As rod 210 is turned it moves back and forth in the direction shown by double headed arrow 138, thereby providing the required mechanical adjustment. End 211 of rod 210 is formed to contact lever 262 and allow for the rotational motion of lever 262 about axle 264.

Screws holding the various parts of the apparatus together are illustrated in FIG. 2, FIG. 5 and FIG. 8. Screws 228, shown in FIG. 2, FIG. 5, and FIG. 8, hold lower retainer ring 226 and upper retainer ring 224 in place against range module housing 150. Stack screws 154, illustrated in FIG. 5 and FIG. 8 hold range module housing 150 to housing 152 Socket 156 in stack screws 154 provide attachment for screws 158 which attach mounting flange 106 to range module 150 and housing 152.

Figure 11:
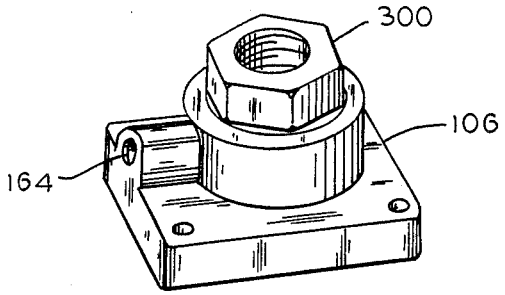
FIG. 11 is an isometric view of a diaphragm actuator.
Figure 12:
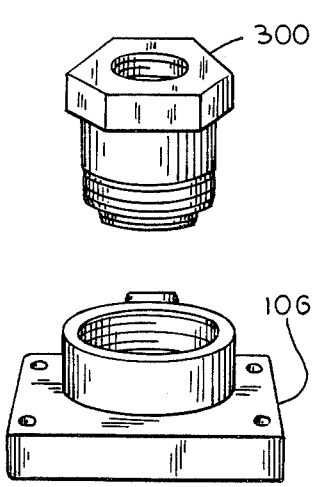
FIG. 12 is a partial assembly drawing of a diaphragm actuator.
Figure 13:
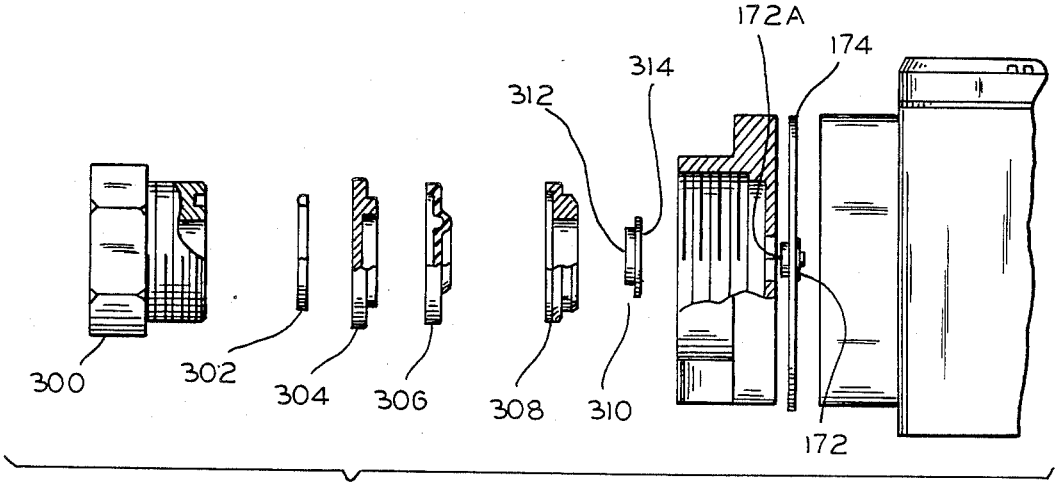
FIG. 13 is an exploded assembly view of a diaphragm actuator.
Figure 14:
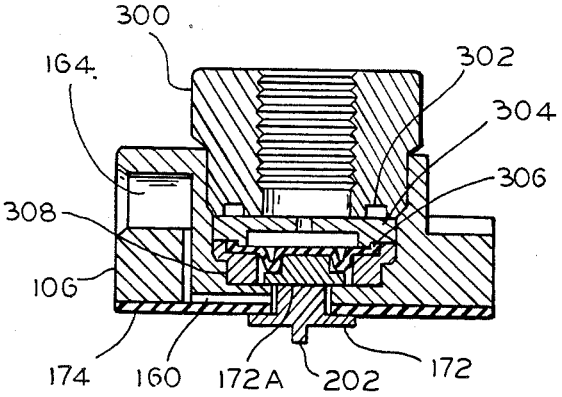
FIG. 14 is a cross-sectional view of a diaphragm actuator.

FIG. 11, FIG. 12, FIG. 13, and FIG. 14 show details of a diaphragm type pressure actuator. Mounting flange 106, as shown in FIG. 11, may be the same mounting flange used on the piston actuators and shown in previous figures such as FIG. 1. Connector 300 screws into mounting flange 106 as illustrated in FIG. 11 and FIG. 12. FIG. 13 is an exploded assembly drawing showing internal parts mounted within connector 300. FIG. 14 is a cross section showing the assembly and including gasket 174 and lifter pin 172. O ring 302 provides a seal between connector 300 and clamp 304. Diaphragm 306 fits against clamp 304 and is held in place by bushing 308. Clamp 304 and bushing 308 fit together so as to put compressive force on diaphragm 306. Pressure plate 310 has a flat surface 312 which matingly fits against diaphragm 306. Pressure plate 310 has a second surface 314 which fits against surface 172A of lifter pin 172. Lifter pin 172 fits through an opening in gasket 174. Pin 202 of lifter pin 172 then fits matingly into hole 204 of lower spring seat 206.

Figure 15:
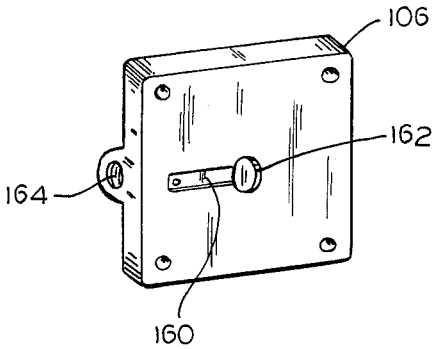
FIG. 15 is a bottom view of a mounting flange.

A bottom view of mounting flange 106 is shown in FIG. 15. Opening 162 provides clearance for lifter pin 172 and also provides a conduit for any fluid leaking through or around diaphragm 306. Fluid leaking into opening 162 may exit from mounting flange 106 by proceeding through drain groove 160 and exiting the apparatus through drain opening 164.

It is to be understood that the above described embodiments are simply illustrative of the principles of the invention. Various other modifications and changes may be made by those skilled in the art which will embody the principles of the invention and fall within the spirit and scope thereof.

What is claimed is

1. A fluid pressure sensitive switch comprising:
first means for producing linear motion in response to fluid pressure;
second means, including a spring and a spring seat, for springably resisting said linear motion;
third means operating said switch after a predetermined linear motion; and
a lifter pin means for decoupling rotational movement of said first means for said spring seat, and having a shoulder engaging said spring seat and a projection on said shoulder which loosely protrudes through, a hole in said spring seat said lifter pin means being mounted between said first means and said spring seat so as to transmit linear force from said first means to said second means without transmitting rotational forces.

2. The apparatus as in claim 1 wherein said first means comprises a piston.

3. The apparatus as in claim 2 wherein said piston has a substantially hemispherical hammer end.

4. The apparatus as in claim 1 wherein said first means comprises:
a piston;
a cylinder into which said piston is fitted;
means for supporting a first end of said piston within said cylinder so that said piston does not touch said cylinder; and
means for supporting a second end of said piston in said cylinder so that said piston does not touch said cylinder.

5. The apparatus as in claim 1 wherein said means for producing linear motion in response to pressure comprises a diaphragm and a pressure plate.

6. The switch as in claim 1 wherein said second means comprises:
a range spring having one end engaging said spring seat for resisting said linear motion; and
an adjustable retainer engaging a second end of said range spring so that adjustment of the position of said retainer adjusts the force by which said linear motion is resisted.

7. The switch as in claim 1 wherein said third means comprises an operating rod for transmitting linear motion, an operating lever, an axle having two ends, on one end of which is mounted said operating lever, said operating lever caused to be rotated by said operating rod, and said switch having an operating plunger, acted on by said lever.

8. The switch as in claim 1 wherein:
said first means is a piston made of stainless steel;
said second means is a spring seat and a spring, where said spring seat retains a first end of said spring, and said spring seat is made of high strength aluminum; and
said third means has:
an operating rod having threads on a first end, said threads screwed into a threaded hole in said spring seat;
a lever operated by said rod and operating said switch; and
where said operating rod is made of heat treated carbon steel, whereby said high strength construction gives a ruggedized apparatus capable of withstanding pressure transients having a high rate of rise.

9. An actuator in a pressure sensitive switch, said pressure sensitive switch having a range spring, a seat engaging a first end of said range spring so that motion of said seat toward said range spring compresses said range spring and operates said switch after a predetermined distance of travel, said actuator having a cylinder and a piston mounted within said cylinder so that pressure applied to a first end of said piston urges a second end of said piston to produce force against said seat and thereby urges compression of said range spring, comprising:
a first ring supporting said first end of said piston within said cylinder;
a second ring supporting said second end of said piston within said cylinder and preventing said piston from touching said cylinder wherein said second ring supporting said second end of said piston comprises:
a slip ring fitting over said piston and said slip ring having a groove in its external surface; and
an O ring fitting into said groove and providing contact with an inner surface of said cylinder.

10. An actuator in a pressure sensitive switch, said pressure sensitive switch having a range spring, a seat engaging said first end of said range spring so that motion of said seat toward said range spring compresses said range spring and operates said switch after a predetermined distance of travel, said actuator having a cylinder and a piston mounted in said cylinder so that pressure applied to a first end of said piston urges a second end of said piston to produce force against said seat and thereby urges compression of said range spring, comprising:
a first ring supporting said first end of said piston within said cylinder;
a second ring supporting said second end of said piston within said cylinder and preventing said piston from touching said cylinder;

a slip ring fitting over said piston and said slip ring having a groove in its external surface;

an O ring fitting into said groove and providing contact with an inner surface of said cylinder; and wherein said slip ring is made of fluorocarbon polymer and said O ring is made of an elastomeric material.

11. An actuator in a pressure sensitive switch, said pressure sensitive switch having a range spring, a seat engaging a first end of said range spring so that motion of said seat toward said range spring compresses said range spring and operates said switch after a predetermined distance of travel, said actuator having a cylinder and a piston mounted within said cylinder so that pressure applied to a first end of said piston urges a second end of said to produce force against said seat and thereby urges compression of said range spring, comprising:

a first ring supporting said first end of said piston within said cylinder;

a second ring supporting said second end of said piston within said cylinder and preventing said piston from touching said cylinder wherein said piston has a substantially hemispherical end; and a lifter pin fitted between said hemispherical end of said piston and said seat at a first end of said range spring so that force is transmitted from said piston to said lifter pin through said substantially hemispherical end of said piston.

12. A pressure sensitive switch comprising:

a piston responsive to pressure, said piston having a substantially flat end for receiving said pressure, and having a substantially hemispherical hammer end;

a lifter pin for receiving force from said hammer end of said piston, and having a projection;

a spring seat having a hole therein for engaging said projection of said lifter pin, and having a substantially circular groove;

a range spring having a first end for matingly seating within said substantially circular groove of said spring seat;

an adjustable retainer for a second end of said range spring for adjusting the compression, and therefore the force exerted by said range spring on said spring seat;

an operating rod having threads on a first end, said threads screwed into a threaded hole in said spring seat;

a lever having an axle and being contacted by said operating rod so that linear motion of said piston under the influence of pressure causes said rod to urge rotational motion of said lever;

a switch having an operating plunger operated by said lever so that linear motion of said piston caused by pressure may urge said operating plunger to move in or out of said switch thereby causing said switch to change state.

13. The apparatus as in claim 12 wherein said piston is made of stainless steel, said spring seat is made of high strength aluminum, and said operating rod is made of heat treated carbon steel in order to provide a rugged construction capable of withstanding pressure transients having a high rate of rise.

14. The apparatus as in claim 13 further comprising:

a cylinder containing said piston;

a first ring supporting said end of said piston having said substantially hemispherically end; and a second ring supporting said substantially flat end of said piston within said cylinder in order to prevent said piston from touching said cylinder.

15. The apparatus as in claim 14 wherein said first ring is made of fluorocarbon polymer and wherein said second ring has a slip ring having a groove in an external surface thereof and an O ring fitted into said groove, and where said slip ring is made of fluorocarbon polymer and said O ring is made of elastomeric material.

16. The apparatus in claim 12 wherein said axle has two ends and said axle is mounted on one end at a predetermined position which is integral to a protective housing for the switch.

17. A pressure sensitive switch comprising:

a piston responsive to pressure, said piston having a substantially flat end for receiving said pressure, and having substantially hemispherical hammer end;

a lifter pin for receiving force from said hammer end of said piston, and having a projection;

a spring seat having a hole therein engaging said projection of said lifter pin, and having a substantially circular groove;

a range spring having a first end matingly seating within said substantially circular groove of said spring seat;

an adjustable retainer engaging a second end of said range spring for adjusting the compression, and therefore the force exerted by said range spring on said spring seat;

an operating rod having threads on a first end, said threads screwed into a threaded hole in said spring seat;

a lever having an axle and being contacted by said operating rod so that linear motion of said piston under the influence of pressure causes said rod to urge rotational motion of said lever;

a switch having an operating plunger operated by said lever so that linear motion of said piston caused by pressure may urge said operating plunger to move in or out of said switch thereby causing said switch to change state; and a resilient pad for receiving kinetic energy of the lever, said pad mounted in a protective housing for the switch at a predetermined position above the lever.

18. The apparatus in claim 17 wherein said adjustable retainer has two ends, at one end thereof there is a rigid support guide for operationally supporting said operating rod in a non deflective manner during operation of the switch.

* * * * *